US005763999A

United States Patent [19]

Matsuno et al.

[11] Patent Number: 5,763,999

[45] Date of Patent: Jun. 9, 1998

[54] LIGHT SOURCE DEVICE USING A DOUBLE-TUBE DIELECTRIC BARRIER DISCHARGE LAMP AND OUTPUT STABILIZING POWER SOURCE

[75] Inventors: Hiromitsu Matsuno; Nobuyuki Hishinuma; Masashi Okamoto; Tatsushi Igarashi; Fumitoshi Takemoto, all of Hyogo-ken, Japan

[73] Assignee: Ushiodenki Kabushiki Kaisha, Tokyo, Japan

[21] Appl. No.: 531,374

[22] Filed: Sep. 20, 1995

[30] Foreign Application Priority Data

Sep. 20, 1994 [JP] Japan ..... 6-250198

[51] Int. Cl.[6] ..... H01J 61/067; H01J 65/04

[52] U.S. Cl. ..... 313/573; 313/607; 313/634; 313/234

[58] Field of Search ..... 313/17, 25, 26, 313/317, 231.41, 231.71, 234, 325, 358, 573, 586, 574, 607, 634, 631, 565, 484, 622, 621, 493; 315/169.4, 248

[56] References Cited

U.S. PATENT DOCUMENTS 4,835,442 5/1989 Sugimoto et al. ..... 313/573
4,837,484 6/1989 Eliasson et al. ..... 313/573
5,283,498 2/1994 Von Arx et al. ..... 313/634
5,444,331 8/1995 Matsuno et al. ..... 313/634
5,581,152 12/1996 Matsuno et al. ..... 313/634

*Primary Examiner*—Sandra L. O'Shea
*Assistant Examiner*—Jay M. Patidar
*Attorney, Agent, or Firm*—Sixbey, Friedman, Leedom & Ferguson; David S. Safran

[57] ABSTRACT

A light source device in which the radiated light from the dielectric barrier discharge lamp can always be stabilized even if the discharge vessel of the dielectric barrier discharge lamp is large or the load on the tube wall within the discharge vessel is small. This is achieved according to the invention by the provision of a light source device having a discharge lamp which has a generally cylindrical, coaxial double-tube arrangement of an outer tube and an inner tube, in which there is an outer electrode on the outer tube, in which there is an inner electrode on the inner tube, and in which a discharge space between the inner and outer tubes is filled with a discharge gas for formation of excimer molecules by a dielectric barrier discharge, and of a power source for operating this discharge lamp in accordance with the relationship: $Vs/Vp \leqq 0.5$ where Vs is the starting voltage and Vp is the voltage applied to the discharge lamp during steady-state luminous operation.

4 Claims, 3 Drawing Sheets

LIGHT SOURCE DEVICE USING A DOUBLE-TUBE DIELECTRIC BARRIER DISCHARGE LAMP AND OUTPUT STABILIZING POWER SOURCE

BACKGROUND OF THE INVENTION

1. Field of the Invention

The invention relates to a light source device using a so-called dielectric barrier discharge lamp in which excimer molecules are formed by a dielectric barrier discharge, and in which the light which is emitted from the excimer molecules is used as a light source, for example, as an ultraviolet light source for a photochemical reaction.

2. Description of Related Art

For example, from Japanese unpublished patent specification HEI 1-144560 or U.S. Pat. 4,837,484, a radiator, i.e., a dielectric barrier discharge lamp, is known as generic technology, in which a discharge vessel is filled with a gas which forms an excimer molecule, and in which light is emitted by a dielectric barrier discharge from the excimer molecules.

This dielectric barrier discharge is also called an ozone production discharge or a silent discharge, as is described in the "Discharge Handbook", Elektrogesellschaft, June 1989, 7th edition, page 263.

In the aforementioned publication, it is described that a transparent discharge vessel which is of a generally cylindrical shape works at least partially also as the dielectric of the dielectric barrier discharge, and in it the light is emitted from the excimer molecules. Furthermore, it is described therein that an outer tube and an inner tube are arranged coaxially with respect to each other as a double tube, that the outside surface of the outer tube is provided with a lattice-like electrode, that the inside surface of the inner tube is provided with an inner electrode, and that the dielectric barrier discharge is produced in a discharge space between the outer tube and the inner tube.

This dielectric barrier discharge lamp is connected to a power source and is supplied from a power supply unit. However, there are also cases in which several lamps are arranged next to one another and are operated by means of a single power source. In this case, operation as a flat light source is essentially achieved by the lamp.

A dielectric barrier discharge lamp of this type has various advantages which neither a conventional mercury low pressure lamp nor a conventional high pressure arc discharge lamp have; for example, emission of ultraviolet beams with short waves, such as 172 nm, 222 nm, and 308 nm, and at the same time generation of light with individual wavelengths with high efficiency which are roughly like line spectra are achieved.

The conventional dielectric barrier discharge lamp, however, has the following disadvantages:

(1) A glass tube or a ceramic tube is used for the material for the outer tube and the inner tube. However, glass tubes have thicknesses and diameters which vary somewhat, even if the same glass tubes or the like are used for several lamps. Furthermore, a single glass tube also has at least slight dimensional variations in its longitudinal direction.

These variations in thicknesses, tube diameter and the like, of course, influence the amount of emitted light since in a dielectric barrier discharge lamp emission is accomplished in which the glass tube works as a dielectric, as is described above. As a result thereof, in the light source device in which the dielectric barrier discharge lamps are arranged next to one another, variations in the amount of light distribution on the irradiated surface occurs. Furthermore, with respect to the amount of light which is emitted from a single lamp, variations also occur in its axial direction. As a result, the emission of light is not uniform. This phenomenon occurs more explicitly, the larger the discharge vessel.

(2) During luminous operation of the lamp microscopically small discharge plasmas with a very short discharge duration, which are referred to as microplasmas below, are formed in the discharge space. The number and frequency of occurrences of these microplasmas decrease when the load on the tube wall within the discharge vessel drops; this indicates a decrease in the amount of light emitted from the lamp.

The above described disadvantages are characteristic of a dielectric barrier discharge lamp which uses a tube wall of a discharge vessel as the dielectric of a dielectric barrier discharge.

On one outside surface of the discharge vessel is an outer electrode. If in the region in which this outer electrode is located the dielectric barrier discharge essentially occurs, and if this region has a large area and a small load on the tube wall, the disadvantage of instability of the amount of light arises.

Specifically, use for an industrial application is possible when the area of the region in which the outer electrode is located is greater than or equal to 160 $cm^2$ and the load of the tube wall is less than or equal to 0.5 $W/cm^2$. In this respect, the above-described instability of the amount of light cannot be ignored.

SUMMARY OF THE INVENTION

A primary object of the present invention is to devise a light source device using a dielectric barrier discharge lamp in which the radiated light from the dielectric barrier discharge lamp can always be stabilized.

The object consists, especially, in achieving stable emission even if the discharge vessel of the dielectric barrier discharge lamp is relatively large or the load on the tube wall within the discharge vessel is small.

A further object is specifically to achieve a light emission which can be easily used for industrial applications, even in the case in which the region of the outside surface of the discharge vessel in which the outer electrode is located has an area of greater than or equal to 160 $cm^2$, or in which the load on the tube wall within the discharge vessel is less than or equal to 0.5 $W/cm^2$.

The above objects and others are achieved according to the invention by the fact that a light source device using a dielectric barrier discharge lamp which has a generally cylindrical, coaxial double-tube arrangement of an outer tube and an inner tube, in which there is an outer electrode on the outside surface of the outer tube, in which there is an inner electrode on the inside of the inner tube, and in which a discharge space is formed between the outer tube and the inner tube that is filled with a discharge gas for formation of excimer molecules by a dielectric barrier discharge, and where the light source device also has a power source for operating the dielectric barrier discharge lamp, with respect to which the starting voltage of the above described dielectric barrier discharge lamp, Vs, (in volts, V) is fixed relative to the voltage applied to the above described dielectric barrier discharge lamp in steady-state luminous operation, Vp (in volts, V) in accordance with the relationship: $Vs/Vp \leqq 0.5$.

The noted objects are also achieved according to the invention by the fact that two or more of the above described dielectric barrier discharge lamps are located next to one another and are used essentially as a planar light source.

Further contributing to the achievement of above objects by the present invention is the fact that, in the above described dielectric barrier discharge lamp, the area of that region in which the above described outer electrode is located is greater than or equal to 160 $cm^2$, and at the same time, the load on the tube wall is less than or equal to 0.5 $W/cm^2$.

Moreover, the object is achieved according to the invention by the fact that the discharge maintenance voltage, Vm (V), the average length of a discharge path, d (cm), and the pressure of the xenon gas, P (kPa) have values in accordance with the relationship: $20 \leqq Vm/(d \times p) \leqq 70$.

It was found that dispersion of the radiated light which occurs as the result variations of the thickness and the tube diameter of the glass tube and the ceramic tube which function as the dielectric in the dielectric barrier discharge lamp is linked to the ratio between the voltage applied to the above described lamp and the starting voltage, and that the variation in the light distribution of the radiated light decreases according to the reduction of starting voltage/applied voltage. According to the invention, the aforementioned disadvantage is eliminated by establishing the ratio thereof.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
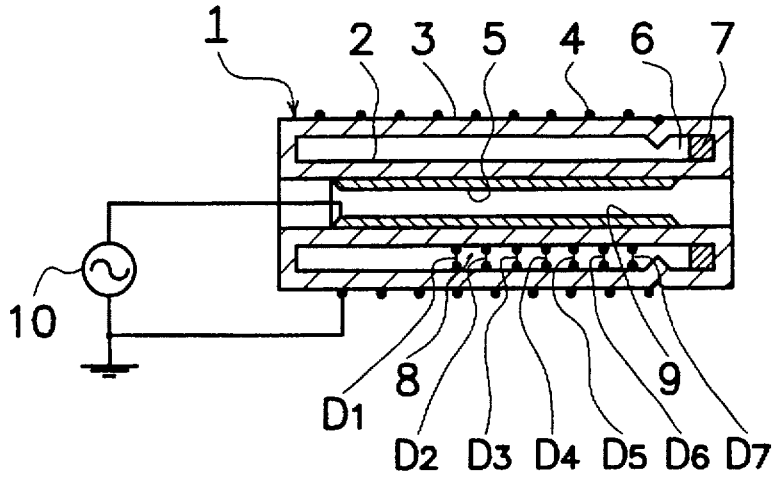
FIG. 1 is a schematic depiction of a first embodiment of the dielectric barrier discharge lamp device according to the invention.

In the drawing reference number 1 indicates a discharge vessel which has a double-tube arrangement in which a synthetic quartz glass inner tube 2 and a synthetic quartz glass outer tube 3 are arranged coaxially with respect to each other. Both ends of the inner tube 2 and the outer tube 3 are closed, and a discharge space 8 is formed the tubes. Specifically, discharge vessel 1 has a total length of, for example, about 300 mm, the inner tube 2 has an outer diameter of 16 mm and a thickness of 1 mm, and the outer tube 3 has an outer diameter of 28 mm and a thickness of 1 mm. In this connection, inner tube 2 and outer tube 3 have a wall thickness variation in a tolerance range of about ±0.1 mm in their respective axial tube direction.

On the inner surface of the inner tube 2, an inner electrode 5 which is made of aluminum and which functions as a light reflector disk is arranged, and a protective film of boron nitride is arranged thereover for mechanical and chemical protection.

Figure 2:
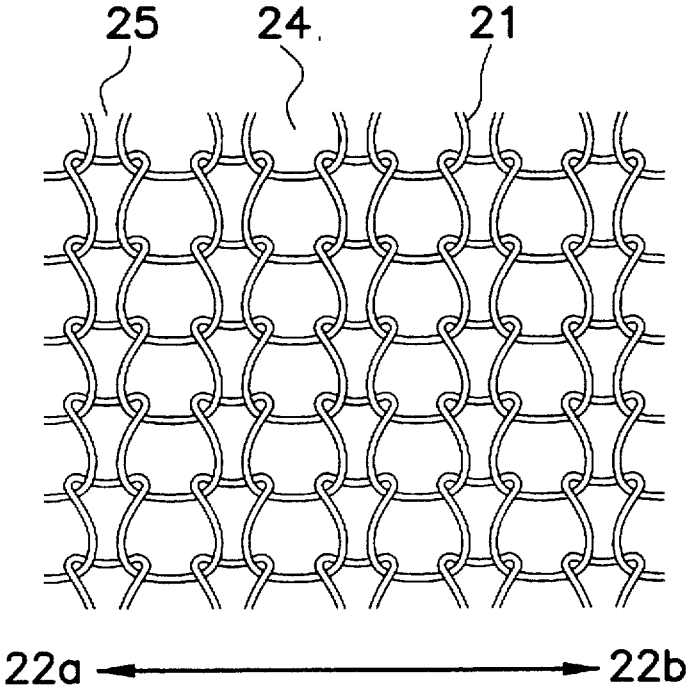
FIG. 2 shows a mesh electrode.

Outer tube 3 functions both as a dielectric of the dielectric barrier discharge and as a light exit window. On its outside surface is lattice-like outer electrode 4. Outer electrode 4 is, as partially illustrated in FIG. 2, formed such that metal wire 21 is knitted seamlessly and cylindrically and in peripheral direction **22*a*–22*b* of the cylinder, loops are repeatedly formed. The metal wire consists for example of monel metal with a strand diameter of 0.1 mm. Large mesh 24 and small mesh 25 have an area of roughly 2 $cm^2$ and an area of roughly 1 $cm^2$ respectively. The outer electrode 4, which is to be arranged head-to-head tightly against the outside surface of outer tube 3, is formed such that discharge lamp 1 can be inserted into this cylindrical metal lattice in the axial direction of the lamp. Specifically, discharge vessel 1 on which outer electrode 4 is located has a length in its axial direction of, for example, 250 mm. That means that, in this embodiment, the outer electrode is located in a region corresponding to a length of 250 mm with respect to the total length of 300 mm of discharge vessel 1. In this case, the region of discharge vessel 1 which borders the above described outer electrode 4** on the opposite side has an area of $\pi \times 2.6 \times 25 = 219.9$ $cm^2$= roughly 220 $cm^2$.

Between inner tube 2 and outer tube 3, a discharge space 8 is formed. In this case, the expression "length of the discharge path" is defined as the shortest radial distance across discharge space 8, i.e., the distance between the inside of outer tube 3 and the outside of inner tube 2 in the case in which between outer electrode 4—outer tube 3—discharge space 8—inner tube 2—and inner electrode 5 a discharge is formed as is illustrated in FIG. 1. Furthermore, the expression "average length of the discharge path" is defined as an average value of this length of the discharge path. In this embodiment, the middle region in the axial direction of the discharge space 8 is called the center to which symmetrically distances D1, D2, D3, D4, D5, D6, and D7 were measured with an interval of 5 mm each. By means of the average thereof, the value of an average length of the discharge path was 5.0 mm.

In discharge space 8, xenon gas, for example with a pressure of 40 kPa is encapsulated as the discharge gas. Between outer electrode 4 and inner electrode 5, for example, an applied voltage of 12 KV with a frequency of 13 KHz is supplied from power source 10, and in this way, luminous operation of the lamp is accomplished.

When the lamp is operated under these conditions, vacuum ultraviolet light in the wavelength range from 160 nm to 180 nm is emitted; it is emitted from excimer molecules of xenon and has its peak value at a wavelength of 172 nm.

One end of discharge vessel 1 in its longitudinal direction is elongated beyond discharge space 8, by which a getter space 6 is formed. In this getter space 6, a barium getter made of a barium alloy is located and by means of high frequency heating, a barium thin film is formed.

Figure 3:
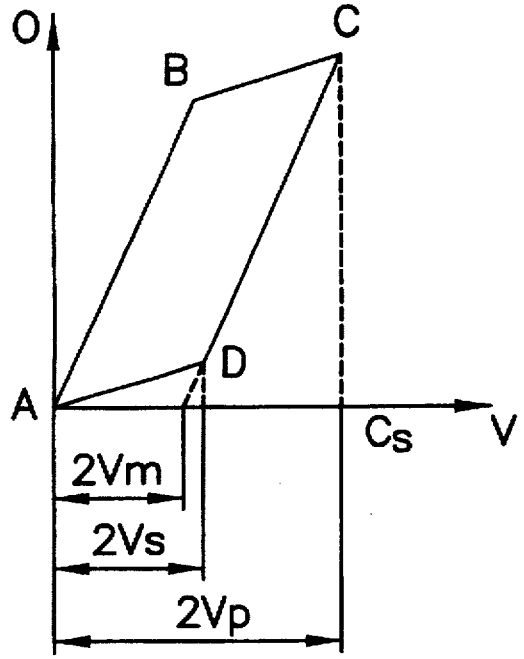
FIG. 3 is a graph of a Lissajous plot.

The dielectric barrier discharge lamp is, as described above, connected to AC source 10. FIG. 3 shows a Lissajous plot of a voltage (V) which is applied to the two ends of outer electrode 4 and the inner electrode 5 of the dielectric barrier discharge lamp (equivalent to the output from AC source 10) and of the integrated value of a current flowing into the lamp, i.e., an amount of electrical charge (0). FIG. 3 shows a measurement which was taken in practice using an oscilloscope.

For the most part a parallelogram is obtained in which, on the one hand, line AB and line DC run essentially parallel to one another, and on the other hand, line BC and line AD run essentially parallel to one another. Based on the area of this parallelogram, the value of the electrical input into the discharge lamp can be computed. In reality, there are also cases in which line AB and line DC are slightly distorted and become curved. However, they were designated as straight lines by way of approximation, as is shown in the drawing, and the value of the electrical input was computed with them.

The expression "applied voltage Vp" is defined as half the value of the voltage which is obtained in FIG. 3 by projection of point Cs onto the horizontal axis. In this way, a maximum value of an applied AC source voltage is described.

The expression "starting voltage Vs" is defined as half the value of the voltage which is obtained by projecting line AD onto the horizontal axis. It corresponds to a voltage which is necessary for start-up of the discharge in the discharge space, and is determined by the type and pressure of the discharge gas, the path length of the discharge space, and the thickness of the dielectric or the like.

The expression "discharge maintenance voltage Vm" is defined as half the length along the horizontal axis between the origin and the point at which the broken line extension of line CD intersects the horizontal axis in FIG. 3. It has the following importance:

In the dielectric barrier discharge, fine pulse-like microdischarges often occur over the entire region of the surface of the dielectric. A microdischarge lasts roughly 10 ns. In a microdischarge, when the voltage applied to the discharge space reaches a voltage value corresponding to the "starting voltage Vs", a discharge is started, and thus, a microdischarge is started.

However, on the surface of the dielectric, after roughly 10 ns, electrical charges are stored and a voltage is formed in the blocking direction. The voltage applied to the discharge space decreases and the microdischarge is stopped. The "discharge maintenance voltage Vm" corresponds to ½ of the total of the "starting voltage Vs" and the voltage at which the above described discharge is stopped, and corresponds to an average voltage of the microdischarge.

If, for example, the outer tube with an outer diameter of 26.5 mm and a thickness of 1 mm as well as an inner tube with an outer diameter of 16.0 mm and a thickness of 1 mm are used, the effective electrode length is 250 mm and xenon with 250 torr as the encapsulated gas and a voltage with a frequency from the power source of 20 kHz are supplied, the "applied voltage Vp" is 4.8 kV, the "starting voltage Vs" is 1.4 KV and the "discharge maintenance voltage Vm" is 0.09 KV.

In the description, line AD and line CB describe a time interval in which the discharge is interrupted. The discharge is started at point D and point B, and between line DC and line BA, formation and extinguishment of the microplasma occur repeatedly.

If, in this case, with reference to the starting voltages, the applied voltage Vp is large, microplasmas form less often. The ratio of the variation of the light output as the result of the variation of the starting voltage Vs, therefore, becomes greater.

If, on the other hand, the ratio of starting voltage Vs to applied voltage Vp is small, as the result of the frequent formations of microplasmas, the variation ratio of the light output decreases, even if the starting voltage varies.

It is, therefore, conceivable that the amount that the radiated light varies between the individual lamps and the variation of the amount of radiated light in the tube axial direction, or in the direction of the tube diameter, for a single lamp tend to decrease, the smaller the ratio of starting voltage Vs to voltage Vp applied to the lamp becomes. The inventors have, therefore, ascertained that the variation of the light output decreases acutely, if the value of Vs/Vp is set to less than or equal to 0.5.

By fixing the value of the starting voltage Vs to the applied voltage Vp to be less than 0.5, a dielectric barrier discharge lamp can be built which has only small variations in the amount of radiated light between the individual lamps or only small variations in the amount of radiated light in the tube axial direction or in the direction of the tube diameter in a single lamp, even if the thickness of the tube wall, the outer diameter of the discharge vessel or the length of the discharge path varies.

Next, by setting the ratio between the "discharge maintenance voltage", the "average path length" and the "xenon pressure", in addition to the above described reduction of the variation in the amount of light radiated, furthermore, a dielectric barrier discharge lamp with a high luminous efficiency can be obtained.

Specifically, the value of Vm/(d×p) is set in the range of 20 to 70, where the "discharge maintenance voltage" is labelled Vm (V), the "average path length" is labelled d (cm) and the "xenon pressure" is labelled P (kPa).

In this case, the expression "luminous efficiency" is defined as the value at which the value of the light output of the dielectric barrier discharge lamp is divided by the value of the electrical input into the dielectric barrier discharge lamp, which is measured by the above described method.

The conceivable reason for the fact that setting the numerical values in this way can yield high luminous efficiency lies in the following:

The inventors studied the stability of the luminous efficiency and discharge by changing the average length of the discharge path d and xenon gas pressure p in different ways. The xenon gas pressure p is the value at a temperature of 25° C. It is conceivable that the greatest factor which dominates luminous efficiency is the energy of the electrons in the discharge plasmas. If, in this case the voltage divided by the average path length, V/d, is converted into a value E, the electron energy is largely a function of E/p. Subsequently, E/p is called the "reduced electrical field".

Studies by the inventors showed that the luminous efficiency drops to less than 10% and that high luminous efficiency of the dielectric barrier discharge lamp cannot be achieved if the reduced electrical field (E/p) falls to less than 20. If, conversely, the reduced electrical field (E/p) was increased and was greater than 70, a considerable reduction of the luminous efficiency occurred. If the reduced electrical field (E/p) was more than 80, both the discharge and also the radiated light became unstable.

This means that by adjusting the average length of discharge path d and xenon gas pressure p and by setting the reduced electrical field (E/P) in the range from 20 to 70, a dielectric barrier discharge lamp could be obtained in which a discharge with relatively high luminous efficiency and at the same time stability is accomplished.

Figure 4:
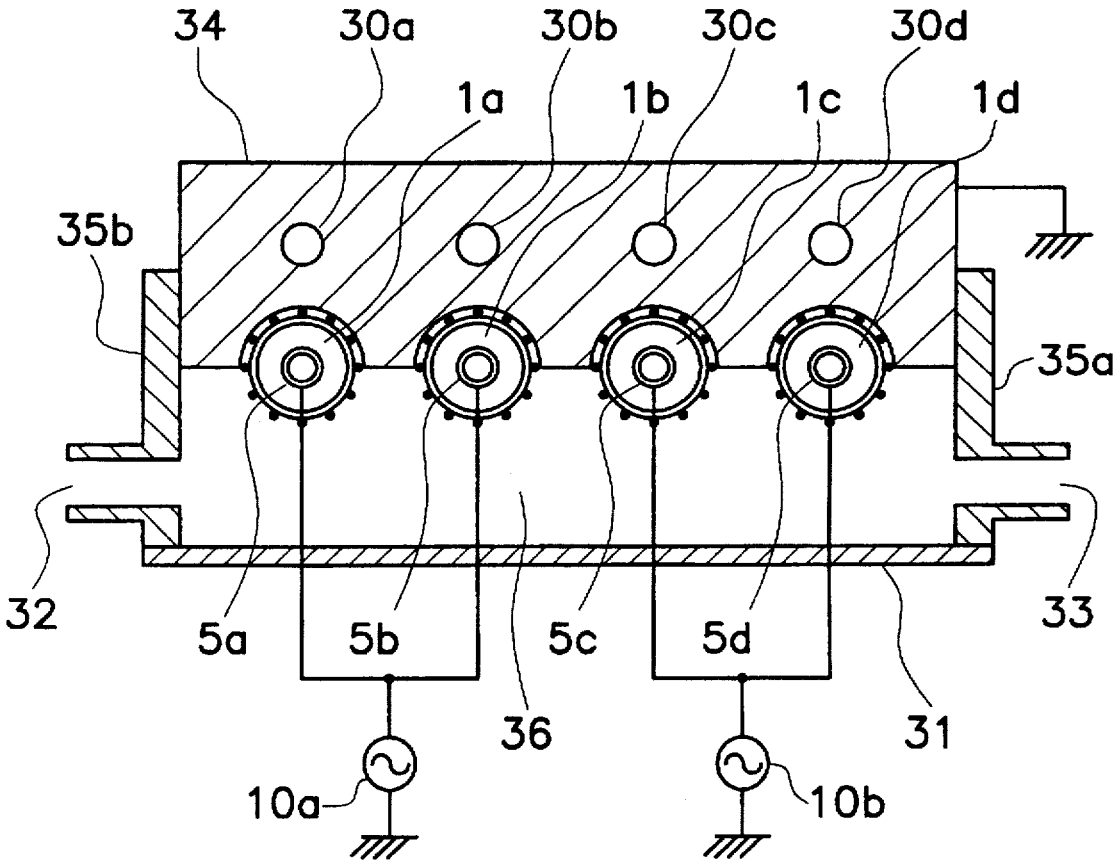
FIG. 4 shows a schematic of a second embodiment of the dielectric barrier discharge lamp device according to the invention.

FIG. 4 shows dielectric barrier discharge lamps arranged and operated next to one another. In the illustration, dielectric barrier discharge lamps 1*a* and 1*b* are connected to power source 10*a* and dielectric barrier discharge lamps 1*c* and 1*d* to power source 10*b*. These four lamps are arranged in parallel to an aluminum cooling block 34, each lamp having an outer diameter of 26.5 mm, an average length of the discharge path of 5.0 mm and an encapsulation pressure of the xenon gas of 55 kPa.

In this case, the measure in which four lamps are arranged next to one another essentially yields a flat light source. The total value of the area of that region of the lamps connected to the power source in which the outer electrodes are located is, for example, about 416 $cm^2$. Reference numbers 30*a*, 30*b*, 30*c* and 30*d* designate openings for the influx of a liquid for purposes of cooling.

Dielectric barrier discharge lamps 1*a*, 1*b*, 1*c*, and 1*d* have inner tubes 5*a*, 5*b*, 5*c*, and 5*d* and are hermetically sealed by a light exit window part 31 formed of synthetic quartz glass, by cooling block 34, side plates 35*a* and 35*b* and by side plates which are located on both ends of the lamps extending parallel to the plane of the drawing and which are not shown therein. The effective light exit area of light exit window part 31 measures, for example, 240 mm×240 mm. Furthermore, space 36 between dielectric barrier discharge lamps 1*a*, 1*b*, 1*c*, and 1*d* and light exit window part 31 is filled with nitrogen gas, which is introduced through an inert gas inlet 32 and is removed via an outlet 33.

The voltage Vp which was applied to the dielectric barrier discharge lamps from power sources 10*a* and 10*b* was set to 9.4 KV, the tube wall load was 0.25 $W/cm^2$ for each lamp, Vs/Vp was 0.32 and the reduced electrical field E/p was 50 (V/cm/kPa).

Vacuum ultraviolet light in the wavelength range from 160 nm to 180 nm and which has its peak at a wavelength of 172 nm was emitted without variation in the axial direction of the tube or in the direction of the tube diameter of the lamp, and at the same time, without variation between the individual lamps, producing light in a uniform manner and with high efficiency. Consequently, a uniform irradiation density was obtained on the surface of light exit window 31, and thus, an essentially flat light source device was obtained at a low price.

If dielectric barrier discharge lamps 1a and 1*d* are connected to power source 10*a* and dielectric barrier discharge lamps 1*b* and 1*c* are connected to power source 10*b*, the advantage is obtained of being able to change the ratio between the middle region of light exit window 31 and the irradiation density of a peripheral area by adjusting the output from current source 10*a*. Furthermore, of course, the four lamps can also all be connected to one power source, the advantage arising that the power source part for the most part has a smaller shape and lower weight.

In none of the above described examples is a fluorescent body applied to the lamp. However, a flat fluorescent lamp can be obtained by applying a fluorescent body to the discharge vessel.

It is to be understood that although preferred embodiments of the invention have been described, various other embodiments and variations may occur to those skilled in the art. Any such other embodiments and variations which fall within the scope and spirit of the present invention are intended to be covered by the following claims.

What we claim is:

1. Dielectric barrier discharge light source device comprising a dielectric barrier discharge lamp which has a generally cylindrical, coaxial double-tube arrangement of an outer tube and an inner tube, in which an outside surface of the outer tube has an outer electrode thereon, in which an inside surface of the inner tube has an inner electrode thereon, in which a discharge space is provided between the outer tube and the inner tube and is filled with a discharge gas for formation of excimer molecules by a dielectric barrier discharge, and a power source is provided as a means for operating the dielectric barrier discharge lamp in accordance with the relationship: $Vs/Vp \leqq 0.5$, Vs is a starting voltage of the dielectric barrier discharge lamp in volts and Vp is a voltage applied to the dielectric barrier discharge lamp during steady-state luminous operation.

2. Dielectric barrier discharge light source device according to claim 1, wherein at least two said dielectric barrier discharge lamps are located next to one another and form an essentially planar source of light.

3. Dielectric barrier discharge light source device according to claim 1, wherein the dielectric barrier discharge lamp has an area that is greater than or equal to 160 $cm^2$ in a region in which the outer electrode is located; and wherein a tube wall load is less than or equal to 0.5 $W/cm^2$.

4. Dielectric barrier discharge light source device according to claim 1, wherein the discharge gas in the discharge space is xenon gas; and wherein $20 \leqq Vm/(d \times p) \leqq 70$, where Vm is a discharge maintenance voltage, d is an average length of a discharge path measured between the inner and outer tubes in centimeters, and P is a pressure of the xenon gas in kPa.

* * * * *